US007292705B2

(12) United States Patent
Harano

(10) Patent No.: US 7,292,705 B2
(45) Date of Patent: Nov. 6, 2007

(54) ANTENNA DEVICE

(75) Inventor: Nobuya Harano, Kakegawa (JP)

(73) Assignee: NEC Corporation, Tokyo (JP)

( * ) Notice: Subject to any disclaimer, the term of this patent is extended or adjusted under 35 U.S.C. 154(b) by 311 days.

(21) Appl. No.: 10/973,913

(22) Filed: Oct. 27, 2004

(65) Prior Publication Data

US 2005/0094840 A1 May 5, 2005

(30) Foreign Application Priority Data

Oct. 28, 2003 (JP) ..... 2003-368862

(51) Int. Cl.
*H04R 25/00* (2006.01)

(52) U.S. Cl. ..... 381/384; 381/370; 455/270

(58) Field of Classification Search ..... 381/370, 381/384; 343/718, 720, 722, 790, 900; 455/270, 455/575.2, 575.5, 575.7, 95, 575.1, 90.3, 455/66.1, 347

See application file for complete search history.

(56) References Cited

U.S. PATENT DOCUMENTS

| | | | | |
|---|---|---|---|---|
| 2,899,549 | A * | 8/1959 | Potter | 455/269 |
| 4,369,521 | A | 1/1983 | Sawada | |
| 5,301,361 | A * | 4/1994 | Koike | 455/95 |
| 6,377,225 | B1 * | 4/2002 | Silverstein | 343/790 |
| 6,677,534 | B2 * | 1/2004 | Yamamoto et al. | 174/113 R |
| 2005/0181844 | A1 * | 8/2005 | Edeler et al. | 455/575.2 |
| 2005/0285799 | A1 * | 12/2005 | Leinonen et al. | 343/702 |

FOREIGN PATENT DOCUMENTS

| | | |
|---|---|---|
| GB | 962100 | 6/1964 |
| GB | 2 380 861 | 4/2003 |
| JP | 1-172731 | 12/1989 |
| JP | 3-109414 | 11/1991 |
| JP | 4-200047 | 7/1992 |
| JP | 7-107148 | 4/1995 |
| JP | 7-298384 | 11/1995 |
| JP | 9-27766 | 1/1997 |

(Continued)

OTHER PUBLICATIONS

Electus Distribution, Impedance Matching: A Primer, 2001, 3 pages.*

(Continued)

*Primary Examiner*—Sinh Tran
*Assistant Examiner*—Joseph Saunders, Jr.
(74) *Attorney, Agent, or Firm*—Young & Thompson

(57) ABSTRACT

An antenna device disclosed herein is integrated with an earphone for generating sound from an ear receiver, and connected to a wireless equipment through a connector to transmit an audio signal applied from the wireless equipment to the connector through a plurality of earphone signal lines. An antenna element lies between the ear receiver and an intermediate position of an earphone signal line for transmitting the audio signal from the connector to the ear receiver. A branch is disposed at the intermediate position for preventing a high frequency signal on each of the plurality of earphone signal lines from passing therethrough, and for passing the audio signal therethrough to extract a signal received by the antenna element. A coaxial line transmits the signal received by the antenna element and extracted by the branch to the connector through a core line possessed thereby.

9 Claims, 7 Drawing Sheets

FOREIGN PATENT DOCUMENTS

| | | | |
|---|---|---|---|
| JP | 9-312894 | | 12/1997 |
| JP | 9-331209 | | 12/1997 |
| JP | 2003-163529 | | 6/2003 |
| JP | 2004266434 A | * | 9/2004 |
| JP | 2005-64742 | | 3/2005 |
| WO | WO 03/026342 | | 3/2003 |

OTHER PUBLICATIONS

Rothammel, Karl: "Antennenbuch", 1991, Franckh-Kosmos Verlags-GMBH, Stuttgart, XP-002310186, ISBN: 3-440-05853-0, pp. 110-111.

* cited by examiner

ANTENNA DEVICE

BACKGROUND OF THE INVENTION

1. Field of the Invention

The present invention relates to an antenna device for a compact wireless equipment, and more particularly, to an antenna device which is incorporated in an earphone connected to a compact wireless equipment.

2. Description of the Related Art

In the field of compact wireless equipments, importance is placed on improvements on portability which can be accomplished by reducing the size and weight of the equipment.

A portable FM radio may be used with an earphone which incorporates an antenna. The use of an earphone with a built-in antenna contributes to improved portability of FM radio because an antenna need not be additionally provided.

In an antenna built-in earphone for use with a portable FM radio, a cable of the entire earphone from an earphone jack is utilized as an antenna. The earphone for use with a compact wireless equipment such as a portable FM radio typically has a cable of one to two meters long. Therefore, the antenna incorporated in the earphone can readily achieve a desired impedance and gain in a frequency band with long wavelengths such as the VHF band (the wavelength of which is on the order of ten to one meter).

An earphone may be used with a mobile telephone in some cases, as disclosed in JP-04-200047-A where such an earphone incorporates an antenna. A mobile telephone described in JP-04-200047-A has an antenna disposed in a head unit, thereby enabling the user to set the mobile telephone at an arbitrary place when the earphone is used. Also, the mobile telephone described in JP-04-200047-A has two antennas in the head unit such that one of the antennas can be selected by a switch for connection to the mobile telephone through a connection cord. This switching is intended to acquire a sufficient field strength by selecting an antenna which presents a higher field strength.

However, the conventional art techniques described above cause the following problems.

The portable FM radio may be used with the earphone, the cable of which may be partially wound up, or partially placed in a pocket. Such a use would result in variations in impedance and gain of the antenna incorporated in the earphone, possibly failing to sufficiently manifest the effect of the antenna.

On the other hand, in the mobile telephone described in JP-04-200047-A, one of the antennas disposed in the head unit is connected to the mobile telephone through the switch and connection cord. In view of high frequency characteristics, the entirety from the antenna in the head unit to the connection cord appears to be continuous, and functions as an antenna. Therefore, the antenna would experience variations in impedance and degraded characteristics if it is used with the wound-up connection cord or if it is placed in a pocket or a bag in its use.

SUMMARY OF THE INVENTION

It is an object of the present invention to provide an antenna device which is capable of exhibiting satisfactory antenna characteristics when an earphone is used by minimizing variations in impedance and gain of the antenna.

To achieve the above object, the antenna device of the present invention is integrated with an earphone for generating sound from an ear receiver, and connected to a radio through a connector to transmit an audio signal applied from the radio to the connector through a plurality of earphone signal lines. The antenna device includes an antenna element, a branch, and a coaxial line.

The antenna element lies between the ear receiver and an intermediate position of an earphone signal line for transmitting the audio signal from the connector to the ear receiver. The branch is disposed at the intermediate position for preventing a high frequency signal on each of the plurality of earphone signal lines from passing therethrough, and for passing the audio signal therethrough to extract a signal received by the antenna element. A coaxial line transmits the signal received by the antenna element and extracted by the branch to the connector through the core line possessed thereby.

The above and other objects, features, and advantages of the present invention will become apparent from the following description with reference to the accompanying drawings which illustrate examples of the present invention.

EMBODIMENTS

A first embodiment of the present invention will be described in detail with reference to the accompanying drawings.

Figure 1:
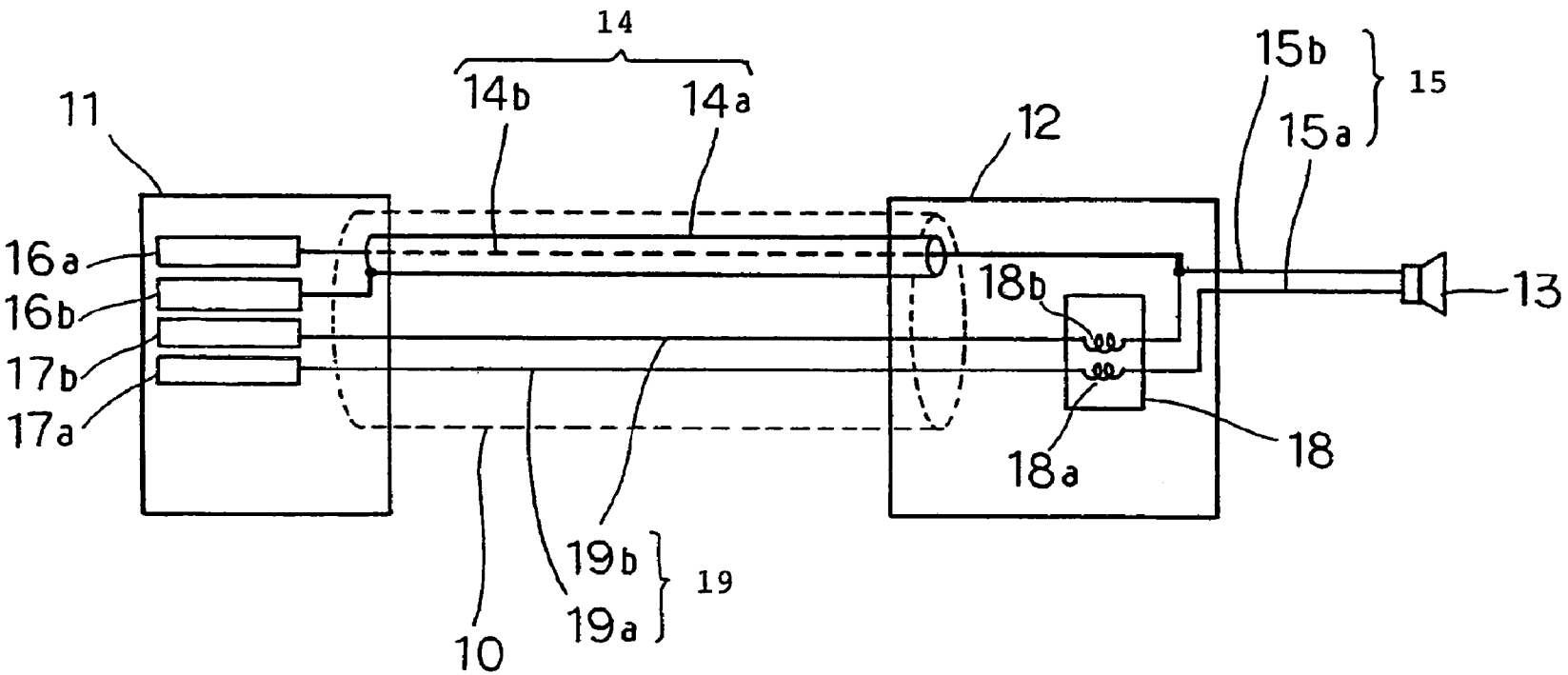
FIG. 1 is diagram illustrating an antenna device according to a first embodiment of the present invention.

FIG. 1 is a diagram illustrating an antenna device according to the first embodiment. The antenna device of this embodiment is integrated with an earphone which is connected to a compact wireless equipment.

Referring to FIG. 1, the antenna device comprises earphone cable 10, connector 11, branch 12, earphone signal line pair 15, and ear receiver 13. Connector 11 is connected to branch 12 through earphone cable 10. Branch 12 is connected to ear receiver 13 through earphone signal line pair 15.

Earphone cable 10 comprises coaxial line 14 composed of shield line 14*a* and core line 14*b*; earphone signal line pair 19 composed of earphone audio line 19*b* and earphone GND line 19*a*; and a single sheath which covers both coaxial line 14 and earphone signal line pair 19. Connector 11 comprises antenna terminal 16*a*, antenna GND terminal 16*b*, earphone terminal 17*b*, and earphone GND terminal 17*a*. Earphone signal line pair 15 comprises earphone audio line 15*b*, and earphone GND line 15*a*. Branch 12 has high frequency separator 18.

In connector 11, antenna terminal 16*a* is connected to core line 14*b*; antenna GND terminal 16*b* is connected to shield line 14*a*; earphone terminal 17*b* is connected to earphone audio line 19*b*; and earphone GND terminal 17*a* is connected to earphone GND line 19*a*.

In branch 12, core line 14*b* is connected to earphone audio line 15*b*. Shield line 14*a* is open toward branch 12. In addition, earphone audio line 15*b* is connected to earphone audio line 19*b* through high frequency separator 18. Earphone GND line 15*a* is also connected to earphone GND line 19*a* through high frequency separator 18.

High frequency separator 18 has inductor 18*b* connected in series between earphone audio line 15*b* and earphone audio line 19*b*; and inductor 18*a* connected in series between earphone GND line 15*a* and earphone GND line 19*a*. Inductance values of inductors 18*a*, 18*b* are determined to be sufficiently low over a frequency range of audio signals, and to be sufficiently high over a frequency range of high frequency signals received by the antenna device.

Connector 11, which is inserted into a receptacle of a compact wireless equipment (not shown) for an earphone which also functions as an antenna, transmits an audio signal from the compact wireless equipment to earphone signal line pair 19, and transmit high frequency signals received by the antenna device to the compact wireless equipment. Ear receiver 13, which has a speaker, is mounted on an ear of the user of the compact radio, and generates sound in accordance with an audio signal applied thereto.

An audio signal applied between earphone terminal 17*b* and earphone GND terminal 17*a* from the compact wireless equipment reaches ear receiver 13 through earphone signal line pair 19, high frequency separator 18, and earphone signal line pair 15. Since the audio signal has low frequencies, it passes through high frequency separator 18. With the audio signal reaching ear receiver 13, sound is generated from ear receiver 13.

On the other hand, earphone audio line 15*b* between branch 12 and ear receiver 13 functions as an antenna element. A signal received by this antenna element is transmitted over coaxial line 14, and applied to the compact wireless equipment from antenna terminal 16*a*. It should be noted that when coaxial line 14 is in close proximity to earphone signal line pair 19, capacitive coupling occurs therebetween. In this embodiment, however, since inductors 18*a*, 18*b* are inserted both in the earphone audio line 19*b* and earphone GND line 19*a*, a high frequency signal generated on earphone signal line pair 19 due to capacitive coupling in earphone cable 10 is blocked by high frequency separator 18, and is prevented from flowing to ear receiver 13.

As described above, the antenna device of this embodiment uses earphone audio line 15*b* as an antenna element, transmits a signal received by this antenna element from branch 12 to connector 11 through coaxial line 14, and removes high frequency noise due to capacitive coupling between coaxial line 14 and earphone audio line 19*b* and earphone GND line 19*a* by high frequency separator 18 of branch 12. Consequently, during a communication using the earphone, radio waves can be received only by earphone audio line 15*b* near ear receiver 13 which would never be wound up or placed in a pocket, with few fluctuations in impedance and reduction in gain. Also, since high frequency separator 18 removes the influence of the capacitive coupling between coaxial line 14 and earphone audio line 19*b* and earphone GND line 19*a* on an audio signal, high quality sound can be generated from ear receiver 13.

Other than the structure illustrated above, earphone audio line 19*b* and earphone GND line 19*a* could be passed through shield line 14*a* together with core line 14*b*. However, earphone audio line 19*b* and earphone GND line 19*a* are preferably passed outside of shield line 14*a* in consideration of impedance matching and reduced gain.

Figure 2:
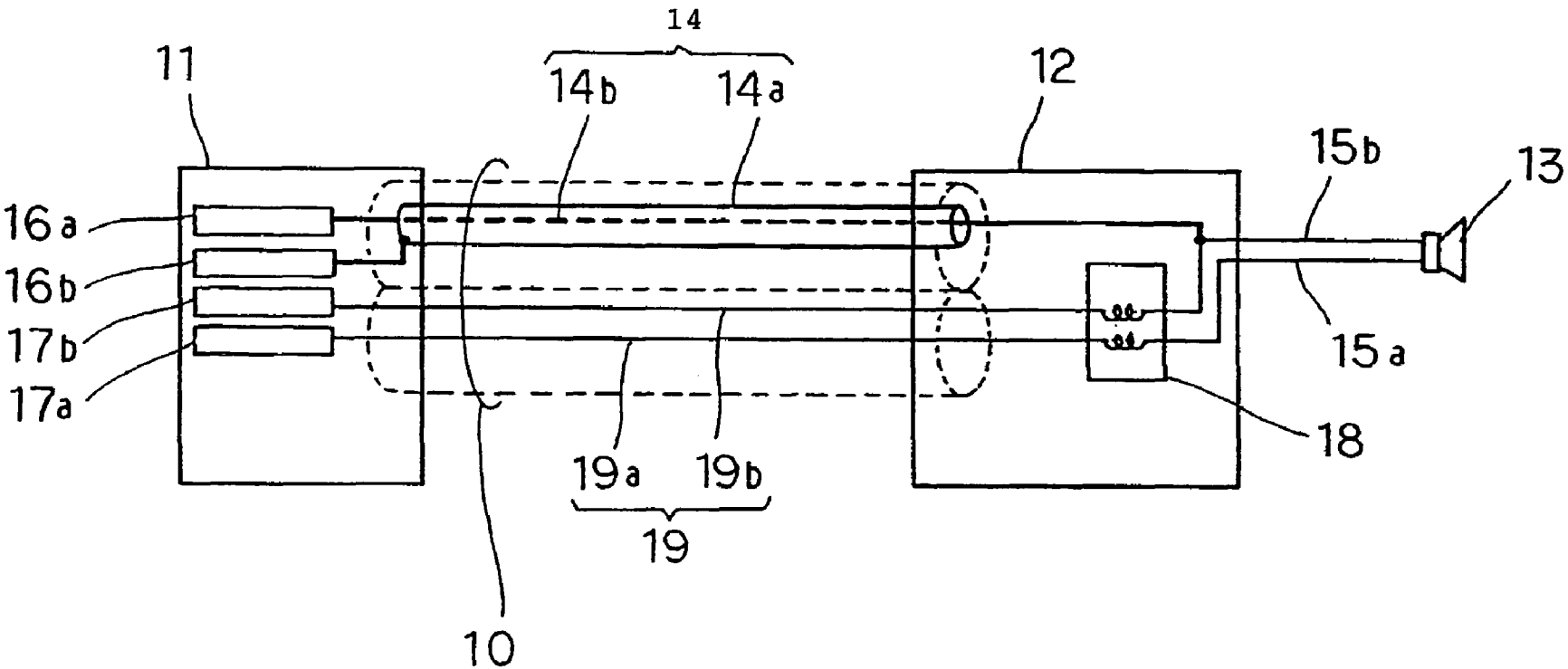
FIG. 2 is a diagram illustrating an example in which a cable is used for an earphone cable between a connector and a branch.

Also, while the foregoing embodiment has illustrated earphone cable 10 which has coaxial line 14 and earphone signal line pair 19 covered with a single sheath, a cable in another structure may be used instead of the illustrated one. FIG. 2 is a diagram illustrating an example which employs a twin cable as earphone cable 10 between connector 11 and branch 12. Referring to FIG. 2, earphone cable 10 implemented by the twin cable has coaxial line 14 and earphone signal line pair 19 which are each covered with an individual sheath, and are joined together.

Description will be next made of a second embodiment of the present invention.

Figure 3:
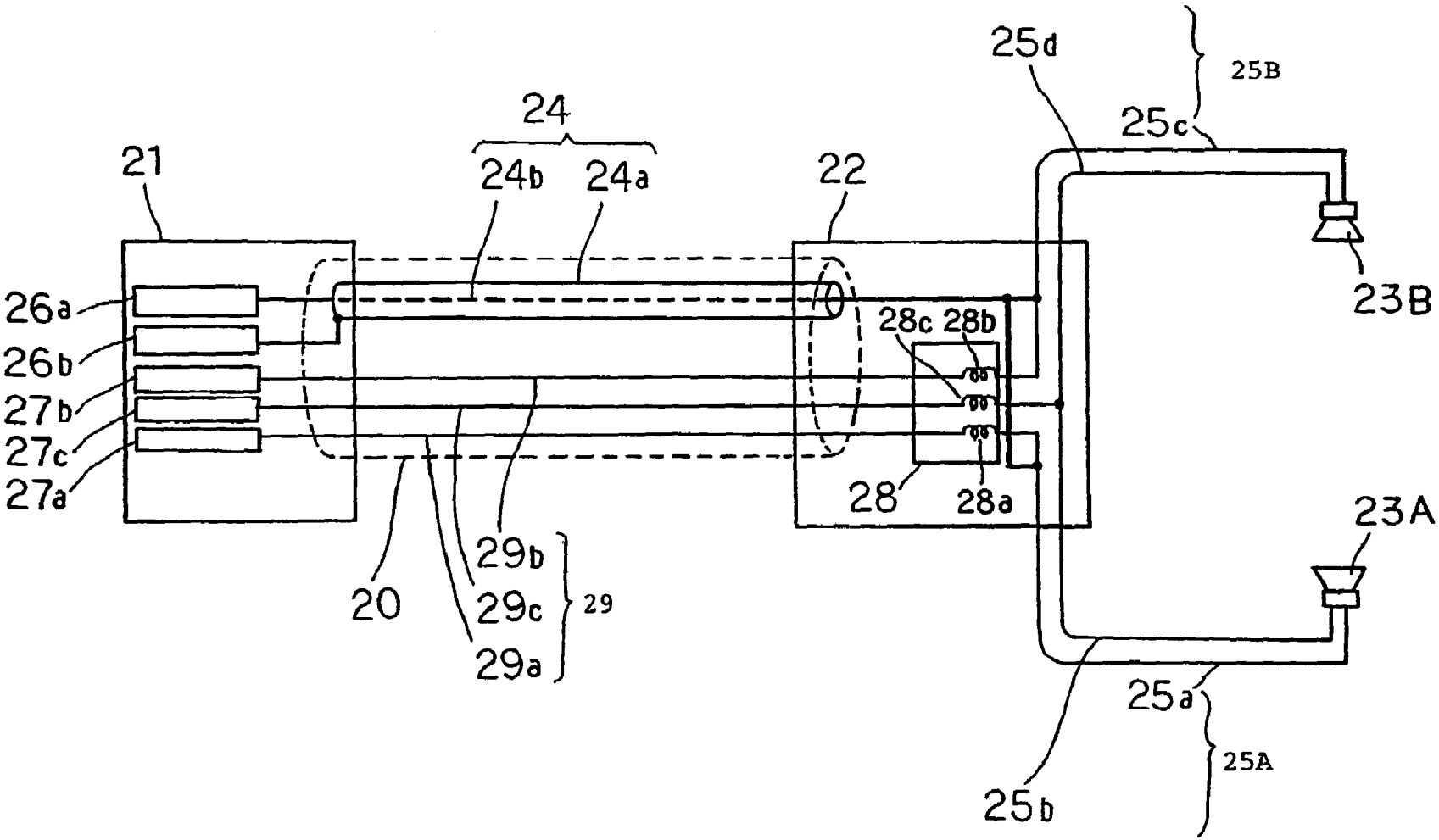
FIG. 3 is a diagram illustrating an antenna device according to a second embodiment of the present invention.

FIG. 3 is a diagram illustrating an antenna device according to the second embodiment. The antenna device of this embodiment differs from the first embodiment in that the antenna device is integrated with a stereo-type earphone.

Referring to FIG. 3, the antenna device comprises earphone cable 20, connector 21, branch 22, earphone signal line pairs 25A, 25B, and ear receivers 23A, 23B. Connector 21 is connected to branch 22 through earphone cable 20. Branch 22 is connected to ear receiver 23A through earphone signal line pair 25A, while branch 22 is connected to ear receiver 23B through earphone signal line pair 25B.

Earphone cable 20 comprises coaxial line 24 composed of shield line 24*a* and core line 24*b*; earphone signal lines 29 composed of earphone L-ch audio line 29*a*, earphone R-ch audio line 29*b*, and earphone GND line 29*c*; and a single sheath which covers both coaxial line 24 and earphone signal lines 29. L-ch indicates the left channel of the stereo, while R-ch indicates the right channel of the same. Earphone GND line 29*c* is shared by L-ch and R-ch. Connector 21 comprises antenna terminal 26*a*, antenna GND terminal 26*b*, earphone L-ch terminal 27*a*, earphone R-ch terminal 27*b*, and earphone GND terminal 27*c*. Earphone signal line pair 25A comprises earphone L-ch audio line 25*a* and earphone L-ch GND line 25*b*. Earphone signal line pair 25B comprises earphone R-ch audio line 25*c* and earphone R-ch GND line 25*d*. Branch 22 has high frequency separator 28.

In connector 21, antenna terminal 26*a* is connected to core line 24*b*; antenna GND terminal 26*b* is connected to shield line 24*a*; earphone L-ch terminal 27*a* is connected to earphone L-ch audio line 29*a*; earphone R-ch terminal 27*b* is connected to earphone R-ch audio line 29*b*; and earphone GND terminal 27*c* is connected to earphone GND line 29*c*.

In branch 22, core line 24*b* is connected to earphone L-ch audio line 25*a* and to earphone R-ch audio line 25*c*. Shield line 24*a* is open toward branch line 22. Also, earphone L-ch audio line 25*a* is connected to earphone L-ch audio line 29*a* through high-frequency separator 28. Earphone R-ch audio line 25*c* is connected to earphone R-ch audio line 29*b* through high frequency separator 28. Earphone L-ch GND line 25*b* and earphone R-ch GND line 25*d*, which are connected in common, is connected to earphone GND line 29*c* through high frequency separator 28.

High frequency separator 28 has inductor 28*a* connected in series between earphone L-ch audio line 25*a* and earphone L-ch audio line 29*a*; inductor 28*b* connected in series between earphone R-ch audio line 25*c* and earphone R-ch audio line 29*b*; and inductor 28*c* connected in series between a juncture of earphone L-ch GND line 25*b* and earphone R-ch GND line 25*d* and earphone GND line 29*c*. The inductance values of inductors 28*a*, 28*b*, 28*c* are determined such that the impedance values are sufficiently low over a frequency range of audio signals and sufficiently high over a frequency range of high frequency signal received by the antenna device.

Connector 21, which is inserted into a receptacle of a compact wireless equipment (not shown) for an earphone which also functions as an antenna, transmits an L-ch audio signal from the compact wireless equipment to earphone L-ch audio line 29*a*; an R-ch audio signal to earphone R-ch audio line 29*b*; and a high-frequency signal received by the antenna from coaxial line 24 to the compact wireless equipment. Ear receivers 23A, 23B, each of which has a speaker, are mounted on the respective ears of the user of the compact wireless equipment, and generate sound in accordance with each of L-ch and R-ch audio signals applied thereto.

An L-ch audio signal applied between earphone L-ch terminal 27*a* and earphone GND terminal 27*c* from the compact wireless equipment reaches ear receiver 23A through earphone L-ch audio line 29*a*, high frequency separator 28, and earphone signal line pair 25A. Likewise, an R-ch audio signal applied between earphone R-ch terminal 27*b* and earphone GND terminal 27*c* from the compact wireless equipment reaches ear receiver 23B through earphone R-ch audio line 29*b*, high frequency separator 28, and earphone signal line pair 25B. Since L-ch and R-ch audio signals have low frequencies, they pass through high frequency separator 28. With the audio signals reaching ear receivers 23A, 23B, sound is generated from ear receivers 23A, 23B.

On the other hand, both earphone L-ch audio line 25*a* between branch 22 and ear receiver 23A, and earphone R-ch audio line 25*c* between branch line 22 and ear receiver 23B function as an antenna element. Thus, the antenna device of the second embodiment can take a longer antenna element than that of the first embodiment, thus providing more satisfactory antenna characteristics.

A signal received by the antenna element is transmitted through coaxial line 24 and applied to the compact wireless equipment from antenna terminal 26*a*. It should be noted that when coaxial line 24 is in close proximity to earphone signal lines 29, capacitive coupling occurs therebetween. However, since inductors 28*a*-28*c* are inserted in all of the earphone L-ch, R-ch audio lines and earphone GND line, a high frequency signal generated on earphone signal lines 29 due to capacitive coupling in earphone cable 20 is blocked by high frequency separator 28, and is prevented from flowing to ear receivers 23A, 23B.

As described above, the antenna device of the second embodiment can take a longer antenna element, in addition to similar advantages offered by the first embodiment, thus providing further satisfactory antenna characteristics.

Description will next be made of a third embodiment of the present invention.

An antenna device of the third embodiment is similar to the second embodiment in that the antenna device is integrated with a stereo-type earphone. The third embodiment, however, differs from the second embodiment in that coaxial lines are used between branch 22 and ear receivers 23A, 23B, and shield lines of the coaxial lines function as antenna elements. In this way, L-ch and R-ch audio signals and signals received by the antenna elements can be separated between branch 22 and ear receivers 23A, 23B.

Figure 4:
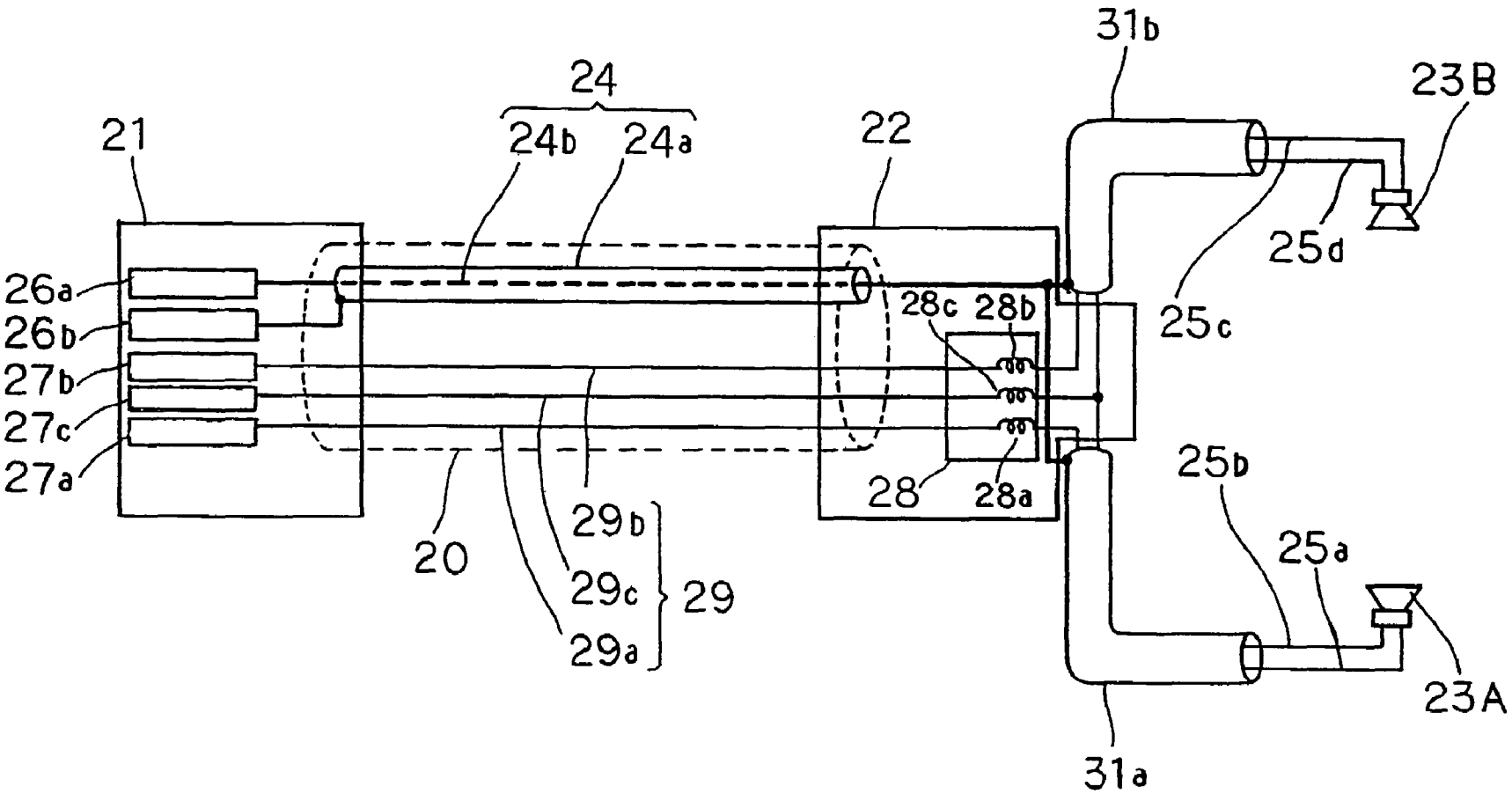
FIG. 4 is a diagram illustrating an antenna device according to a third embodiment of the present invention.

FIG. 4 is a diagram illustrating the antenna device according to the third embodiment. In the antenna device of the third embodiment illustrated in FIG. 4, the following description will focus on the differences from the antenna device of the second embodiment. Branch 22 is connected to ear receiver 23A through a coaxial line which has earphone L-ch audio line 25*a* and earphone L-ch GND line 25*b* passing through earphone L-ch shield line 31*a*. Likewise, branch 22 is connected to ear receiver 23B through a coaxial line which has earphone R-ch audio line 25*c* and earphone R-ch GND line 25*d* passing through earphone R-ch shield line 31*b*. In branch 22, core line 24*b* is connected to earphone L-ch shield line 31*a* and to earphone R-ch shield line 31*b*. Earphone L-ch shield line 31*a* is open toward ear receiver 23A, as is earphone R-ch shield line 31*b* open toward ear receiver 23B. The rest of FIG. 4 is identical to FIG. 3.

Therefore, according to the antenna device of the third embodiment, since audio signals are separated from signals received by the antenna elements between branch 22 and ear receivers 23A, 23B, the antenna device can further reduce noise possibly introduced into the audio signal, in addition to similar advantages offered by the second embodiment.

Description will be next made of a fourth embodiment of the present invention.

An antenna device of the fourth embodiment is also similar to the second and third embodiments in that the antenna device is integrated with a stereo-type earphone. However, the fourth embodiment differs from the second embodiment in that GND lines between a branch and ear receivers function as an antenna element, and that a lumped-constant matching circuit is provided in the branch for achieving impedance matching between the antenna element and a core line between the connector and branch. With this configuration, it is possible to prevent a degraded gain due to impedance mismatch in the branch.

Figure 5:
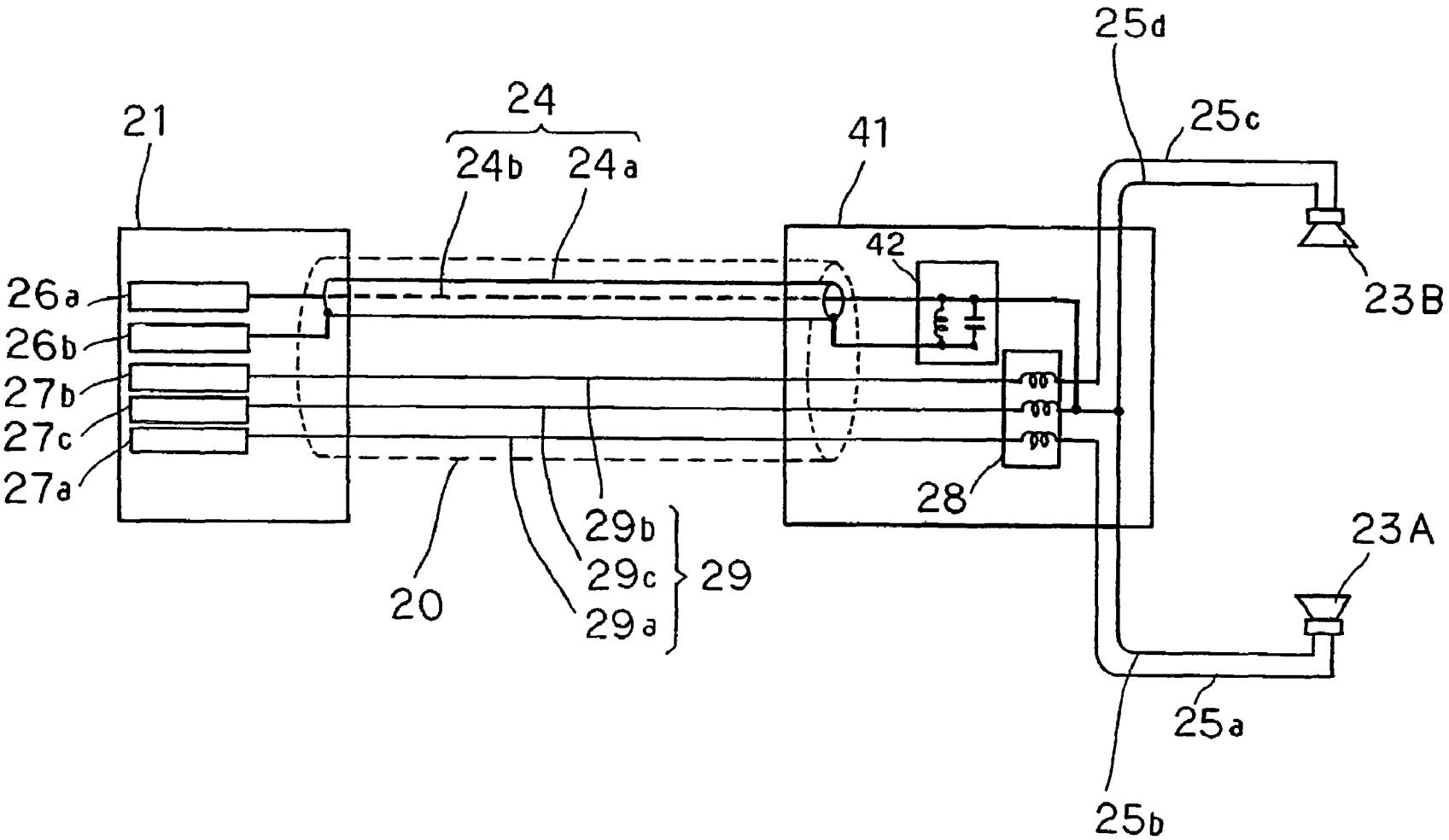
FIG. 5 is a diagram illustrating an antenna device according to a fourth embodiment of the present invention.

FIG. 5 is a diagram illustrating an antenna device according to the fourth embodiment. In the antenna device of the fourth embodiment illustrated in FIG. 5, description will focus on the differences from the antenna device of the second embodiment illustrated in FIG. 3. Branch 41 has a predetermined lumped-constant matching circuit 42 other than high frequency separator 28. In branch 41, core line 24*b* of coaxial line 24 between connector 21 and branch 41 is connected to earphone both L-ch GND line 25*b* and earphone R-ch GND line 25*d*, which function as an antenna element, through matching circuit 42.

Thus, according to the antenna device of the fourth embodiment, since impedance matching can be achieved between core line 24*b* of coaxial line 24 and the antenna element by matching circuit 42, in addition to similar advantages offered by the second embodiment, the antenna device can prevent a reduced gain caused by impedance mismatch.

Description will now be made of a fifth embodiment of the present invention.

The antenna device of the fifth embodiment is also similar to the second to fourth embodiments in that the antenna device is integrated with a stereo-type earphone, and is also similar to the fourth embodiment in that the GND lines between the branch and ear receivers function as an antenna element. However, the fifth embodiment differs from the fourth embodiment in that impedance matching between the antenna element and a core line between the connector and branch is achieved by a distributed-constant stub circuit. The fifth embodiment is identical to the fourth embodiment in that it is intended to prevent a reduced gain caused by impedance mismatch.

Figure 6:
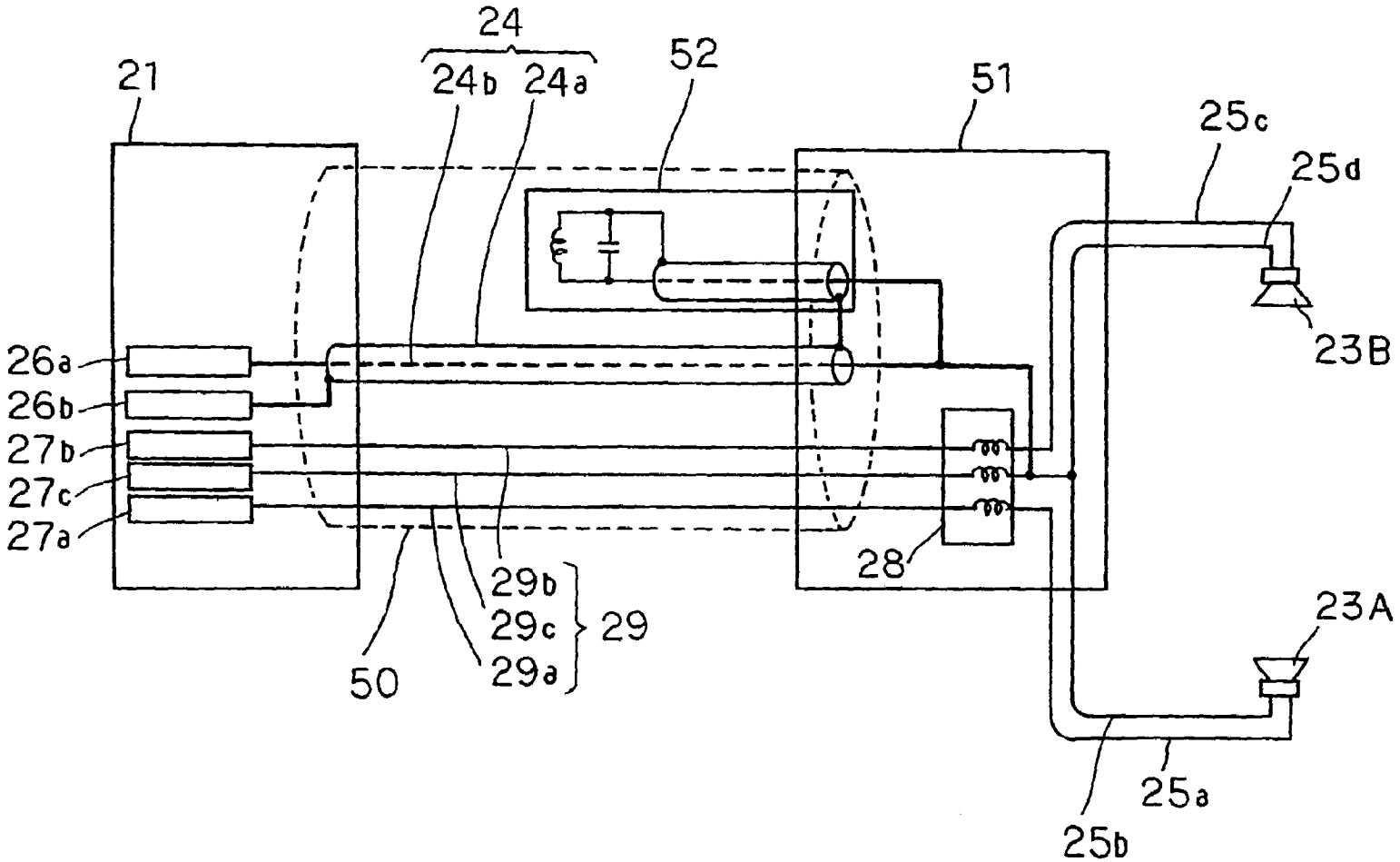
FIG. 6 is a diagram illustrating an antenna device according to a fifth embodiment of the present invention.

FIG. 6 is a diagram illustrating the antenna device according to the fifth embodiment. In the antenna device of the fifth embodiment illustrated in FIG. 6, description will focus on differences from the antenna device of the fourth embodiment. Stub circuit 52 is covered with a sheath together with coaxial line 24 and earphone signal lines 29, and contained in earphone cable 50. Branch 51 has a wiring structure for connecting coaxial line 24 to stub circuit 52 instead of a matching circuit.

Accordingly, the antenna device of the fifth embodiment can provide similar operational advantages to the fourth embodiment.

Description will next be made of a sixth embodiment of the present invention.

An antenna device of the sixth embodiment is again similar to the second to fifth embodiments in that the antenna device is integrated with a stereo-type earphone, and is also similar to the fourth and fifth embodiments in that GND lines between a branch and ear receivers are used as an antenna element.

Figure 7:
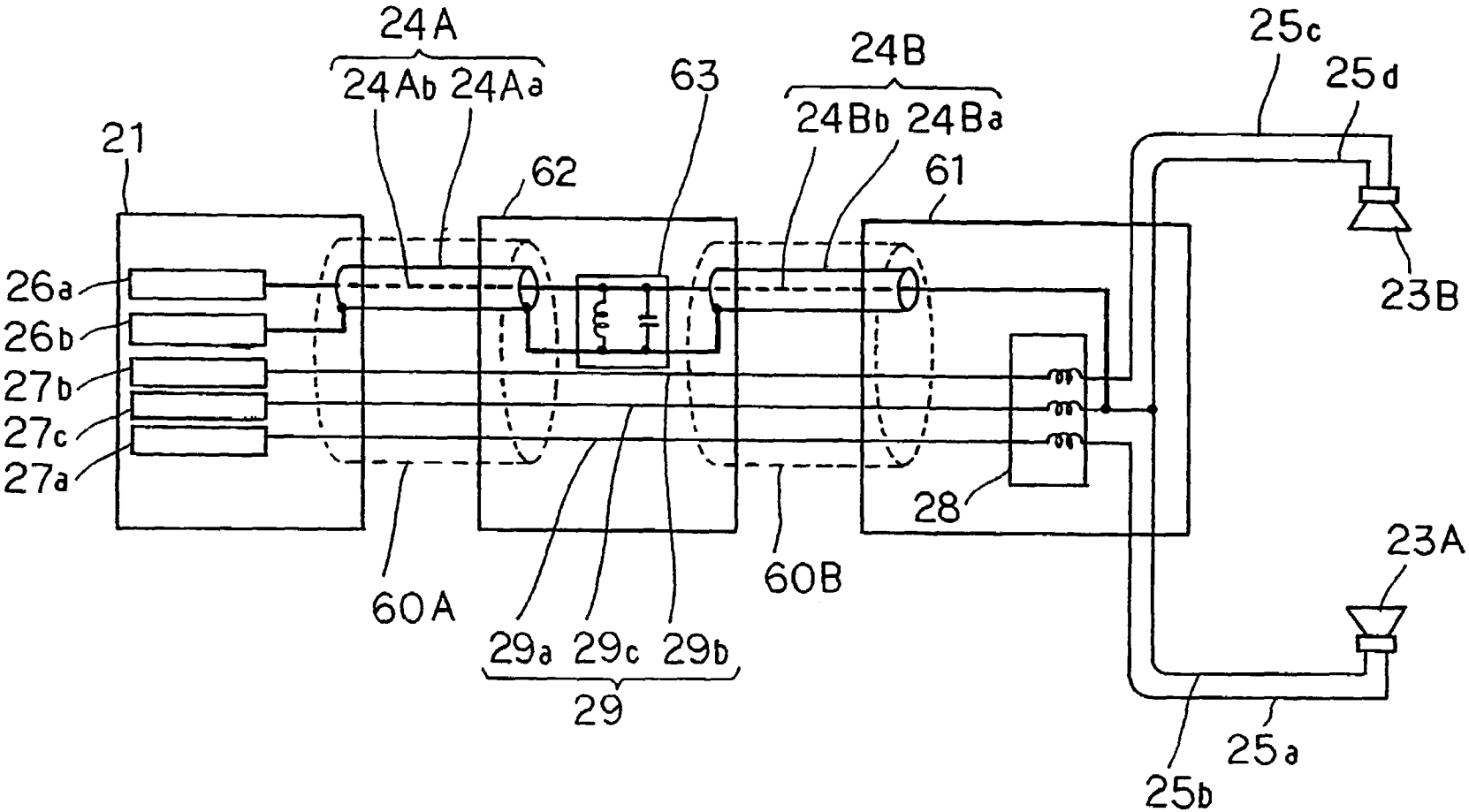
FIG. 7 is a diagram illustrating an antenna device according to a sixth embodiment of the present invention.

FIG. 7 is a diagram illustrating the antenna device according to the sixth embodiment. In this embodiment, unlike the fourth and fifth embodiment, relay 62 is provided between connector 21 and branch 61. Relay 62 simply passes L-ch and R-ch audio signals on earphone signal lines 29 therethrough. However, relay 62 has a matching adjuster 63 between coaxial line 24A, which is connected between connector 21 and relay 62, and coaxial line 24B,which is connected between relay 62 and branch 61.

Matching adjuster 63 achieves impedance matching between connector 21 and branch 61 with a predetermined lumped constant. The lumped constant is determined to be a value which satisfactorily adjusts the impedance characteristics, when viewed from connector 21, in consideration of the impedance characteristics in branch 61.

While preferred embodiments of the present invention have been described using specific terms, such description is for illustrative purposes only, and it is to be understood that changes and variations may be made without departing from the spirit or scope of the following claims.

What is claimed is:

1. An antenna device integrated with an earphone for generating sound from an ear receiver, said antenna device connected to a wireless equipment through a connector to transmit an audio signal, applied from said wireless equipment to said connector, through an earphone signal line, said antenna device comprising:

an antenna element lying between said ear receiver and an intermediate position of an earphone signal line for transmitting the audio signal from said connector to said ear receiver, said antenna element being a shield line of a first coaxial cable that has said earphone signal line as a core line;

a connection unit disposed at said intermediate position and including a connection line that is connected to said shield line of said first coaxial cable and extracting a signal received by said antenna element; and a second coaxial line for transmitting the signal received by said antenna element and extracted by said connection unit to said connector through a core line of said second coaxial line.

2. The antenna device according to claim 1, wherein:

said earphone is a stereo type one which includes a pair of left and right earphone signal lines extending forward from said connection unit and a pair of left and right ear receivers, and said antenna element is formed between said connection unit and both of said ear receivers.

3. The antenna device according to claim 1, wherein:

said earphone is a stereo type one which includes a pair of left and right earphone signal lines extending forward from said connection unit and a pair of left and right ear receivers, and said antenna element is formed between both of said ear receivers between which lies said connection unit.

4. The antenna device according to claim 1, wherein said connection unit includes a matching circuit for achieving impedance matching between said antenna element and said second coaxial line with a predetermined lumped constant.

5. The antenna device according to claim 1, further comprising a stub circuit for achieving impedance matching between said antenna element and said second coaxial line with a predetermined distributed constant.

6. The antenna device according to claim 1, further comprising a matching adjuster for achieving impedance matching halfway on said second coaxial line.

7. The antenna device according to claim 1, wherein said earphone signal line and said second coaxial line are covered with an individual sheath between said connector and said connection unit.

8. An antenna integrated with an earphone, comprising:

an earphone having an audio line and a ground line;

a branch spaced from said earphone and having a high frequency separator connected to said audio line and said ground line;

a connector having connections for an antenna terminal, an antenna ground, an earphone terminal, and an earphone ground; and a cable connecting said connector to said branch, said cable comprising (a) a coaxial line with a shield connected to said antenna ground and a core connected to said antenna terminal and to said audio line in said branch between said high frequency separator and said earphone, and (b) a signal line pair separate from said coaxial line and having a first line connected to said earphone terminal and to said audio line through said high frequency separator and a second line connected to said earphone ground and to said ground line through said high frequency separator, wherein said audio line is an antenna.

9. The antenna integrated with an earphone of claim 8, further comprising a second earphone terminal in said connector, a third line in said signal line pair that is connected to said second earphone terminal, and a second earphone, said second earphone having a second audio line and a second ground line, said core being connected to said second audio line in said branch between said high frequency separator and said second earphone, said second ground line being connected to said ground line in said branch, and said second audio line being connected to said third line through said high frequency separator, wherein said second audio line is also an antenna.

* * * * *